US008432420B2

(12) United States Patent
Kakuta et al.

(10) Patent No.: US 8,432,420 B2
(45) Date of Patent: Apr. 30, 2013

(54) THERMAL PRINTER AND INK RIBBON CASSETTE

(75) Inventors: Yuko Kakuta, Tokyo (JP); Atsushi Takagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 137 days.

(21) Appl. No.: 13/168,005

(22) Filed: Jun. 24, 2011

(65) Prior Publication Data

US 2011/0316956 A1 Dec. 29, 2011

(30) Foreign Application Priority Data

Jun. 28, 2010 (JP) ..... 2010-146185

(51) Int. Cl.
*B41J 2/325* (2006.01)

(52) U.S. Cl.
USPC ..... 347/171; 347/172; 347/176; 347/214; 347/215; 347/217; 400/208.1; 400/240.3; 400/240.4

(58) Field of Classification Search ..... 347/171, 347/172, 174, 176, 214, 215, 217; 400/207, 400/208, 208.1, 237, 238, 240, 240.3, 240.4
See application file for complete search history.

(56) References Cited

U.S. PATENT DOCUMENTS 6,121,987 A * 9/2000 Sasaki et al. ..... 347/176
2007/0146469 A1* 6/2007 Takizawa et al. ..... 347/212

FOREIGN PATENT DOCUMENTS

JP 11-34451 A 2/1999

* cited by examiner

*Primary Examiner* — Huan Tran
(74) *Attorney, Agent, or Firm* — Canon U.S.A., Inc., IP Division

(57) ABSTRACT

A thermal printer is proposed that includes an ink ribbon on which a color ink portion and a non-color ink portion are alternately formed in a conveyance direction, a supply bobbin on which the ink ribbon is wound, a take-up bobbin on which the ink ribbon is to be wound, and a housing that contains the supply bobbin and the take-up bobbin. When an error occurs during transferring of an ink on the color ink surface, the ink ribbon is conveyed so that a portion of the ink ribbon exposed from the ink cassette between the supply bobbin and the take-up bobbin is the non-color ink portion.

13 Claims, 21 Drawing Sheets

THERMAL PRINTER AND INK RIBBON CASSETTE

BACKGROUND OF THE INVENTION

1. Field of the Invention

The present invention relates to a thermal printer using an interchangeable ink ribbon and an ink ribbon cassette that is detachably attached thereto.

2. Description of the Related Art

In recent years, thermal printers have been mainly adopting a disposable, replaceable ink ribbon cassette for the sake of user's convenience. When the ink ribbon cassette of the disposable, replaceable type is adopted, the ink ribbon stored therein is replaced with a new one after it is used up.

When the new ink ribbon is fixed into the ink ribbon cassette, a user's hand may touch a surface of the bare new ink ribbon. In such a case, ink applied on the surface of the ink ribbon may contaminate the hand. Further, when the hand touches the surface of the ink ribbon, foreign matters such as sweat (finger print) of the hand or dust may adhere to the surface of the ink ribbon. If the ink ribbon to which the foreign matters adhere is used in printing with thermal transfer, printing problems may occur when the thermal transfer is performed, deteriorating image qualities such as color falling-out and color unevenness. Therefore, an ink ribbon cassette for solving such problems is proposed.

The ink ribbon cassette discussed in Japanese Patent Application Laid-Open No. 11-34451 is provided with a lead tape on which the ink is not applied at both ends of the ink ribbon. The lead tape has a length for covering a most outer peripheral surface of the ink ribbon when the ink ribbon is completely taken up by one of a feed real (bobbin) or a take-up reel (bobbin). Thus, the surface of the ink ribbon can be protected by the lead tape and, further, a user can replace the ink ribbon without touching the ink ribbon.

However, in a case of the ink ribbon cassette discussed in Japanese Patent Application Laid-Open No. 11-34451, the ink ribbon is replaced after the ink ribbon is entirely reeled from the feed reel to the take-up reel. Thus, for example, when a size of paper is to be changed, the ink ribbon may be replaced before the ink ribbon is entirely taken up. In such a case, an ink face of the ink ribbon described in Japanese Patent Application Laid-Open No. 11-34451 is exposed and the hand may touch the ink, which may adhere to the hand. Further, in this case, when the ink ribbon is re-used, the image quality may be deteriorated as described above.

SUMMARY OF THE INVENTION

The present invention is directed to an ink ribbon unit and a thermal printer that can prevent a color ink portion of an ink ribbon from being exposed when the ink ribbon is replaced before reeling is completed.

According to an aspect of the present invention, a thermal printer that transfers color ink onto recording paper, includes a mounting unit configured to mount a detachable ink cassette on the thermal printer, the ink cassette including an ink ribbon on which a color ink portion with the color ink applied and a non-color ink portion with no color ink applied are alternately formed in a conveyance direction, a supply bobbin on which the ink ribbon whose color ink is to be transferred by the thermal printer is wound, a take-up bobbin on which the ink ribbon drawn from the supply bobbin is wound, and a housing that supports the supply bobbin and the take-up bobbin being apart from each other so that the ink ribbon is exposed between the supply bobbin and the take-up bobbin; and a ribbon transfer unit configured to, when an error occurs during transferring of the color ink, convey the ink ribbon so that the exposed portion of the ink ribbon is the non-color ink portion.

According to another aspect of the present invention, an ink cassette that is detachably attached to a thermal printer that transfers ink of an ink ribbon onto recording paper by a thermal head includes: an ink ribbon on which a color ink portion with the color ink applied and a non-color ink portion with no color ink applied are alternately formed in a conveyance direction; a supply bobbin on which the ink ribbon whose color ink is to be transferred by the thermal printer is wound; a take-up bobbin on which the ink ribbon drawn from the supply bobbin is wound; a housing configured to support the supply bobbin and the take-up bobbin being apart from each other so that the ink ribbon is exposed between the supply bobbin and the take-up bobbin, wherein the color ink portion includes a plurality of color inks applied thereon, and the non-color ink portion is larger than the color ink portion for one color.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
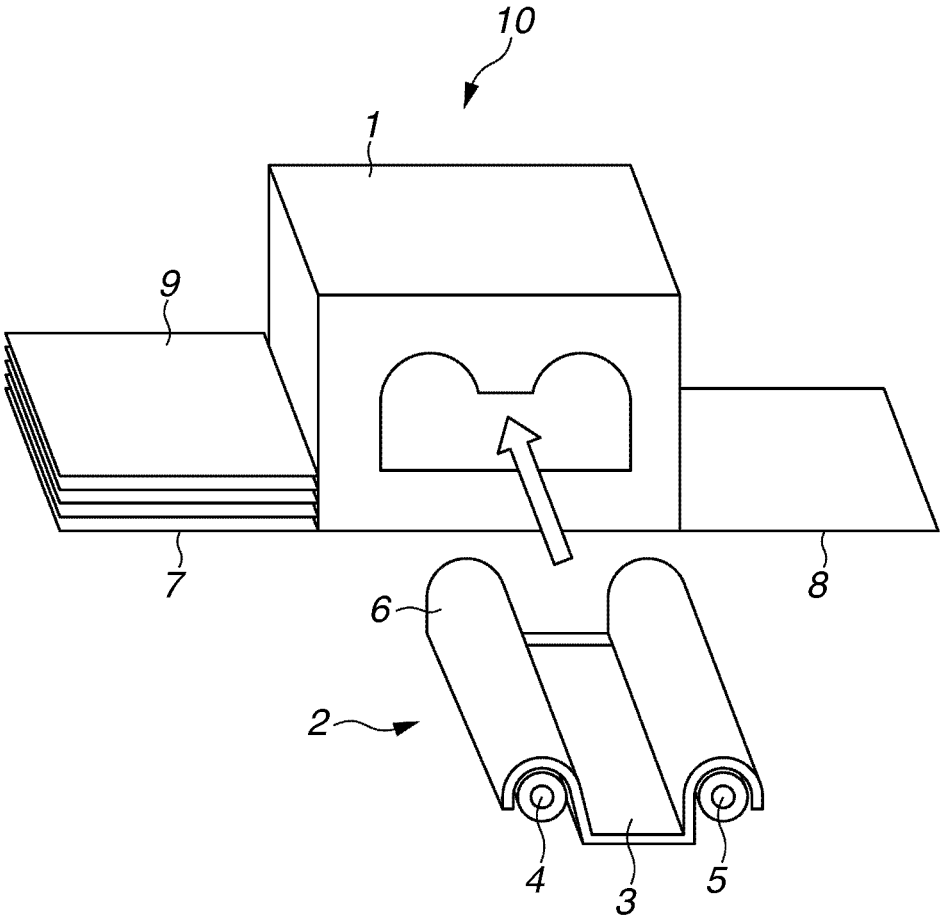
FIG. 1 is a perspective view illustrating an exemplary embodiment of a thermal printer of the present invention.

FIG. 1 is a perspective view illustrating a first exemplary embodiment of a thermal printer of the present invention. As illustrated in FIG. 1, a thermal printer 10 of the present exemplary embodiment includes a main body 1 and an ink ribbon cassette 2 detachably attached thereto. The main body 1 includes, at each of both sides thereof, a paper feed unit 7 where an unused recording medium 9 is mounted and a paper discharge unit 8 where a printed recording medium 9 is mounted. The recording medium 9 is conveyed from the paper feed unit 7 into the main body 1 of the thermal printer 10. After printing is performed on the recording medium 9 by the main body 1, the recording medium 9 is conveyed through the main body 1 to the paper discharge unit 8. According to the present invention, paper in a sheet shape or rolled paper in a roll shape can be adopted as the recording medium 9.

Figure 2:
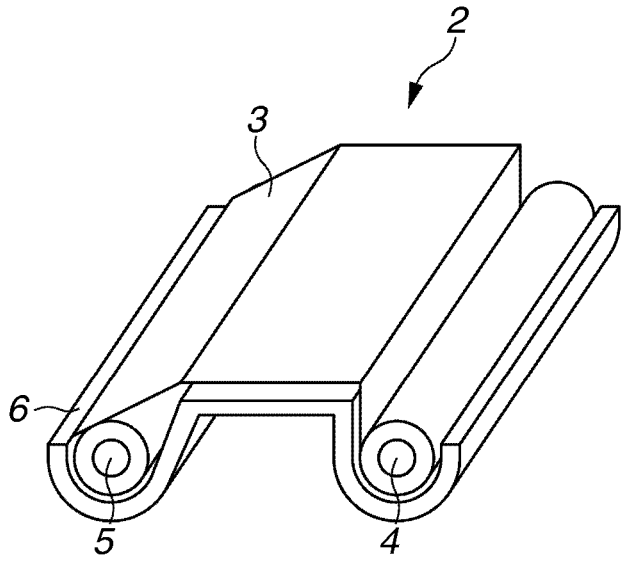
FIG. 2 is a perspective view illustrating an exemplary embodiment of an ink ribbon cassette of the present invention.

FIG. 2 is a perspective view illustrating an exemplary embodiment of an ink ribbon cassette of the present invention.

The ink ribbon cassette illustrated in FIG. 2 is a perspective view when the ink ribbon cassette 2 illustrated in FIG. 1 is viewed from below. The ink ribbon cassette 2 includes an ink ribbon 3, a supply bobbin 4, a take-up bobbin 5, and a case 6. The supply bobbin 4 and the take-up bobbin 5 are rotatably stored in the case 6 placed apart from each other. In the ink ribbon cassette 2, the unused ink ribbon 3 is reeled in a roll shape by the supply bobbin 4 and the used ink ribbon 3 is reeled in a roll shape by the take-up bobbin 5. The supply bobbin 4 and the take-up bobbin 5 are stored in the case 6. At this point, the ink ribbon 3 is exposed between the supply bobbin 4 and the take-up bobbin 5.

Figure 3:
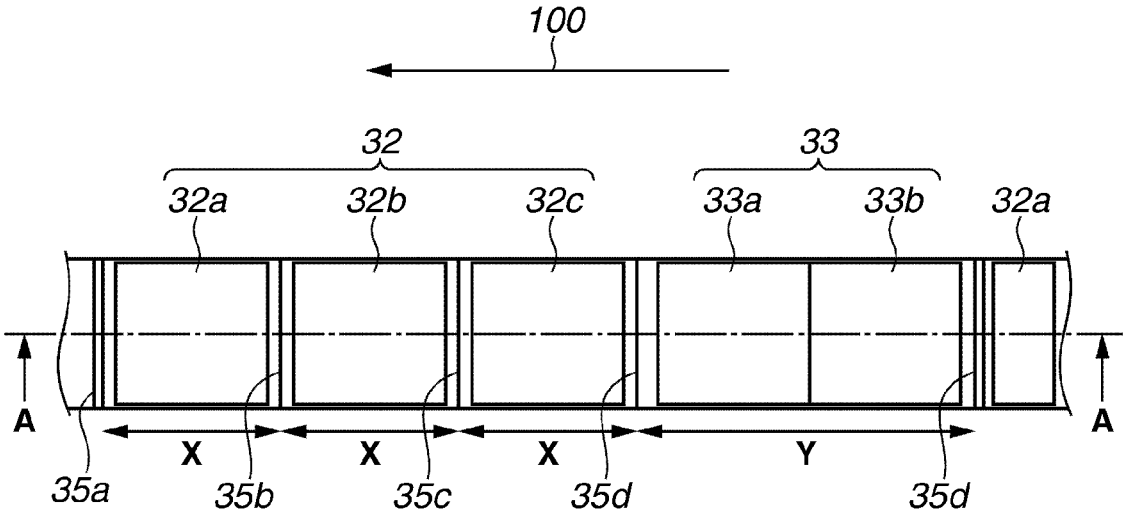
FIG. 3 is a top plan view illustrating a configuration of an ink ribbon provided in the ink ribbon cassette illustrated in FIG. 2.
Figure 4:
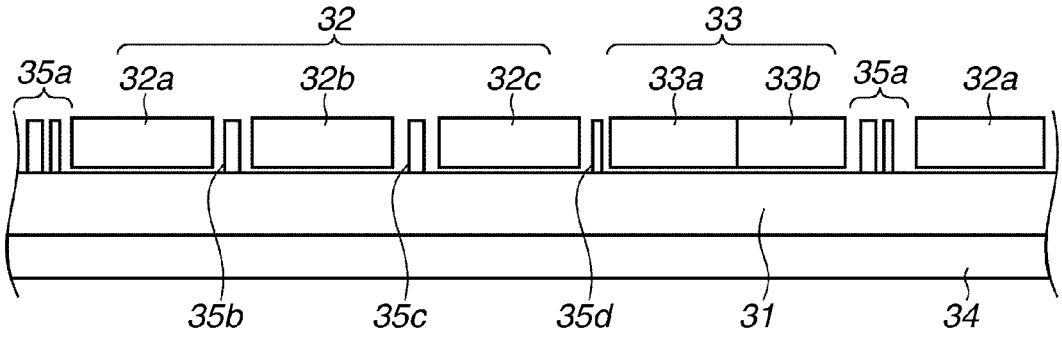
FIG. 4 is a cross-sectional view taken along the line of A-A illustrated in FIG. 3.

FIG. 3 is a top plan view illustrating a configuration of the ink ribbon of the present exemplary embodiment. Further, FIG. 4 is a cross-sectional view taken along the line of A-A illustrated in FIG. 3. According to the present exemplary embodiment, the ink ribbon 3 illustrated in FIG. 4 includes a base sheet 31 including polyethylene terephthalate (PET). A color ink portion 32 onto which ink (color ink) to be thermal transferred onto the recording medium 9 is applied and a non-color ink portion 33 onto which the ink is not applied are formed on a front surface of the base sheet 31. A rear face layer 34 is formed on a rear surface thereof. By heating the rear face layer 34, the ink applied onto the color ink portion 32 is transferred onto the recording medium 9. In other words, around the time when the print operation for thermal-transferring the ink onto the recording medium 9 is performed, the color ink portion 32 having the applied ink thereon thermal-transfers the ink onto the recording medium 9.

As illustrated in FIG. 3, the ink ribbon 3 is alternately formed of the color ink portion 32 and the non-color ink portion 33 in a conveyance direction thereof (refer to an arrow 100). The ink ribbon 3 prints on the recording medium 9 one image plane including a pair of the color ink portion 32 and non-color ink portion 33 as one set and has a length for printing 20 image planes to 50 image planes. At a boundary of each set, as illustrated in FIG. 3, two ribbon markers 35*a* are formed arranged closely to each other.

On the color ink portion 32, a yellow (Ye) face 32*a* is arranged in front, and a magenta (Mg) face 32*b* and a cyan (Cy) face 32*c* sequentially in the conveyance direction. At a boundary between the Ye face 32*a* and the Mg face 32*b*, a ribbon marker 35*b* is formed. At a boundary between the Mg face 32*b* and the Cy face 32*c*, a ribbon marker 35*c* is formed. At a boundary between the Cy face 32*c* and the non-color ink portion 33, a ribbon marker 35*d* is formed. The ribbon markers 35*b*, 35*c*, and 35*d* are different from the ribbon marker 35*a* in that they are formed of one ribbon marker.

On the other hand, in the non-color ink portion 33, a protection ink face 33*a* is continuously formed behind the ribbon marker 35*d* in the conveyance direction and transparent face 33*b* is continuously formed behind the protection ink face 33*a* in the conveyance direction. In the protection ink face 33*a*, non-color, transparent protection ink for protecting the ink transferred onto the recording medium 9 is applied. According to the present exemplary embodiment, the protection ink is adhesive agent including transparent thermal plastic resin as a material. In the transparent face 33*b*, nothing is applied. As the ink ribbon 3 is reeled by the take-up bobbin 5, a peripheral length of an outer periphery of a reel circle of the ink ribbon 3 formed on the take-up bobbin 5 is increased.

Accordingly, a length necessary for reeling the used ink ribbon 3 by the take-up bobbin 5 is increased. Thus, when a space between the protection ink face 33*a* and the ribbon marker 35*a* is small, the ribbon marker 35*a* may be reeled together with the protection ink face 33*a* by the take-up bobbin 5. In this case, the Ye face 32*a* positioned behind the ribbon marker 35*a* in the conveyance direction is not detected. Thus, in order to secure the space between the protection ink face 33*a* and the ribbon marker 35*a*, the transparent face 33*b* is provided.

According to the present exemplary embodiment, the Ye face 32*a*, the Mg face 32*b*, and the Cy face 32*c* have the same length "X", and the protection ink face 33*a* has the same length as "X" or longer (refer to FIG. 3). A length "Y" of the non-color ink portion 33 is longer than that of an exposed portion of the ink ribbon 3 between the supply bobbin 4 and the take-up bobbin 5.

Figure 5:
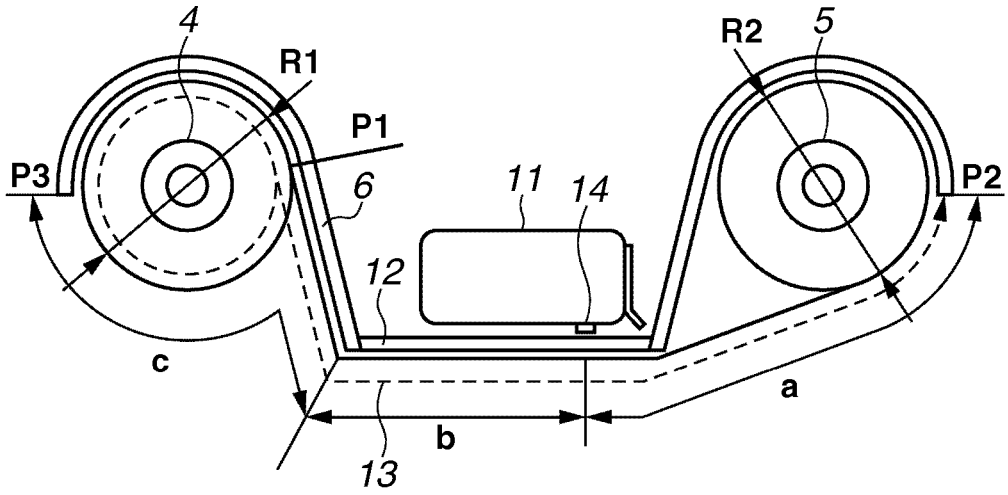
FIG. 5 a cross-sectional view illustrating a state where the ink ribbon cassette illustrated in FIG. 2 is attached into a thermal printer.

FIG. 5 is a cross-sectional view illustrating a state where the ink ribbon cassette of the present exemplary embodiment is attached into a thermal printer. The ink ribbon 3 is reeled in a roll shape by the supply bobbin 4 in a state where the ink to be thermal-transferred onto the recording medium 9 is applied onto the Ye face 32*a*, the Mg face 32*b*, and the Cy face 32*c* (unused state). The rear face layer 34 of the ink ribbon 3 drawn from the supply bobbin 4 when the print operation is performed is heated up by a heating device 14 provided at a thermal head 11. With this heat, the ink of each color applied onto the color ink portion 32 is transferred onto the recording medium 9. Afterward, the ink ribbon 3 that has been used is reeled by the take-up bobbin 5.

According to the present exemplary embodiment, the ink ribbon 3 is reeled by the supply bobbin 4 with the color ink portion 32 placed in the inside and reeled by the take-up bobbin 5 with the color ink portion 32 placed in the outside. However, the present invention does not limit to reeling the ink ribbon 3 by the supply bobbin 4 and the take-up bobbin 5 in such a manner as described above. Even if the ink ribbon 3 is reeled by the supply bobbin 4 and the take-up bobbin 5 in the opposite way to that illustrated in FIG. 5, as long as the length of the non-color ink portion 33 of the ink ribbon 3 is longer than that of an exposed portion 13 of the ink ribbon 3, the ink ribbon 3 can be used. By dividing the exposed portion 13 into three regions, each region will be described in detail.

A region "a" illustrated with a dotted line in FIG. 5 includes an area from a position right below the heating device 14 to a leading end portion P2 of the exposed portion 13 positioned forward in the conveyance direction. A region "b" from the region "a" located backward in the conveyance direction includes an area from the position right below the heating device 14 to a position where the ink ribbon 3 reaches an end 12 of the case 6 and an angle for forwarding the ink ribbon 3 is changed. A region "c" from the region "b" located backward in the conveyance direction includes an area from the end 12 of the case 6 to P3 where another end of the case is positioned backward (side of the supply bobbin 4) in the conveyance direction. The regions "a", "b", and "c" illustrate the areas where the ink ribbon 3 is exposed.

Actually, the ink ribbon is not exposed at a side which the case 6 covers from P1 to P3. However, since the ink sheet at a side which the case 6 does not cover from P3 to P1 is exposed, as illustrated in FIG. 5, a portion from P3 to P1 indicated with the dotted line where the exposed ink sheet is placed is defined as the exposed portion 13.

In other words, the exposed portion 13, of the ink sheet reeled from the supply bobbin 4 to the take-up bobbin 5, indicates a portion of the ink sheet including all portions that are not covered with the case 6, and reeled at the most outer peripheries of the 4 and the take-up bobbin 5 and exposed from the case 6.

Figure 6:
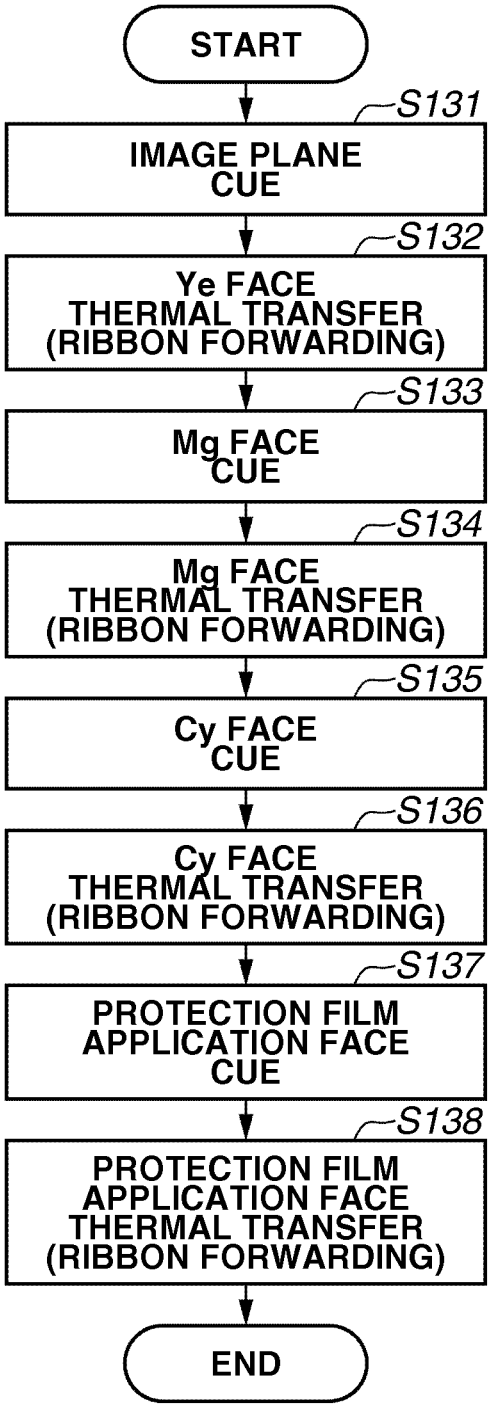
FIG. 6 is a flowchart illustrating processing for conveying an ink ribbon performed when the thermal printer illustrated in FIG. 1 performs a print operation.

Next, in the thermal printer of the present exemplary embodiment, processing of the operation for conveying the ink ribbon performed when the print operation is performed will be described. FIG. 6 is a flowchart illustrating processing of the operation for conveying the ink ribbon performed when the thermal printer of the present exemplary embodiment performs the print operation.

After the print operation is started, first, in step S131, an image plane cue operation is performed. More specifically, to adjust a start end portion of the Ye face 32*a* to a printing start position (position right below the heating device 14), the ink ribbon 3 is conveyed from the supply bobbin 4 to take-up bobbin 5 until an optical sensor (not illustrated) detects the ribbon marker 35*a* (refer to FIG. 3). When the ribbon marker 35*a* is detected, the conveyance of the ink ribbon 3 is stopped. In step S132, the thermal transfer of the ink applied on the Ye face 32*a* is performed while forwarding the ink ribbon 3. When the thermal transfer is performed, since the ink ribbon 3 is placed on the recording medium 9 to be conveyed together at a time, the ribbon is forwarded.

Next, in step S133, a cue operation of the Mg face 32*b* is performed. More specifically, the ink ribbon 3 is conveyed until the above-described optical sensor detects the ribbon marker 35*b* (refer to FIG. 3). In step S134, the thermal transfer of the ink applied on the Mg face 32*b* is performed while forwarding the ink ribbon 3. In step S135, the cue operation of the Cy face 32*c* is performed.

More specifically, the ink ribbon 3 is conveyed until the above-described optical sensor detects the ribbon marker 35*c* (refer to FIG. 3). In step S136, the thermal transfer of the ink applied on the Cy face 32*c* is performed while forwarding the ink ribbon 3. In step S137, the cue operation of the protection ink face 33*a* is performed. More specifically, the ink ribbon 3 is conveyed until the above-described optical sensor detects the ribbon marker 35*d*. At this point, the transparent face 33*b* is not recognized and skipped. In step S138, the thermal transfer of the protection ink applied on the protection ink face 33*a* is performed while forwarding the ink ribbon 3. With the operations described above, the print operation for one image plane is completed.

Figure 7:
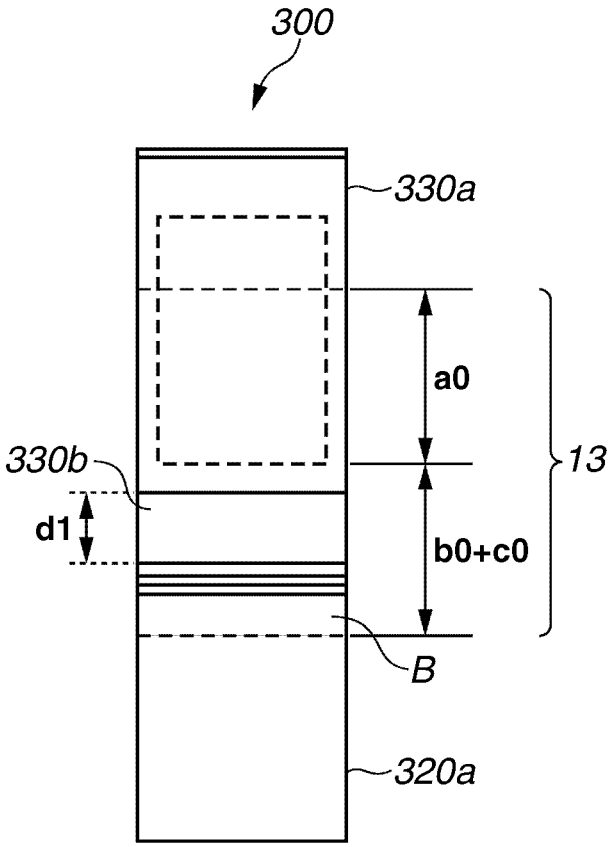
FIG. 7 is a top plan view illustrating an ink ribbon whose transparent face is shorter than that illustrated in FIG. 8.

FIG. 7 is a top plan view illustrating an ink ribbon whose transparent face is shorter than the ink ribbon of the present exemplary embodiment. Further, FIG. 8 is a top plan view illustrating an ink ribbon of the present exemplary embodiment.

A protection ink face 330*a* of an ink ribbon 300 illustrated in FIG. 7 is positioned at the leading end portion P2 when printing for one image plane is completed. At this point, since a transparent face 330*b* has a short length d1, which is about 10 mm, a part of a next Ye face 320*a* (refer to a shaded area B illustrated in FIG. 7) is exposed. Thus, when the ink ribbon 300 is replaced in this state, the user's hand may touch the yellow ink.

Figure 8:
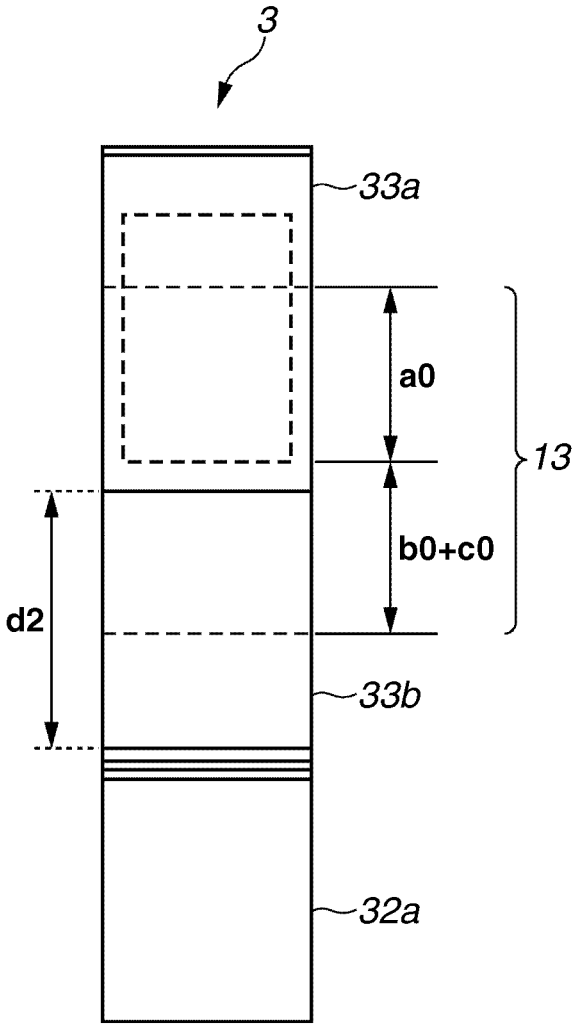
FIG. 8 is a top plan view illustrating a configuration of an ink ribbon provided in the ink ribbon cassette illustrated in FIG. 2.

As illustrated in FIG. 8, according to the present invention, a length d2 of the transparent face 33*b* is extended to about 20 mm so that the next Ye face 32*a* is not exposed when the print operation for one image plane is completed. Thus, even if the ink ribbon 3 is replaced in this state, the user's hand does not touch the color ink. A region a0 illustrated in FIGS. 7 and 8 indicates a portion of the ink ribbon 300 positioned at the region "a" illustrated in FIG. 5 and its length is 15.8 mm according to the present invention. Further, a region b0 indicates a portion of the ink ribbon 300 located at the region "b" illustrated in FIG. 5, and its length is 25.3 mm according to the present invention. Furthermore, a region c0 indicates a portion of the ink ribbon 300 positioned at the region "c" illustrated in FIG. 5, and its length is 25.3 mm according to the present invention.

According to the present exemplary embodiment, a length of the exposed portion 13 from the protection ink face 33*a* positioned at the leading end portion P2 to a terminating end portion of the transparent face 33*b* positioned backward in the conveyance direction when the print operation is completed is longer than a length of the exposed portion 13. Therefore, even if the ink ribbon 3 has not yet been completely reeled by the take-up bobbin 5, the color ink portion 32 can be prevented from being exposed. When the ink ribbon 3 is replaced before reeling is completed, the color ink portion 32 of the ink ribbon 3 is prevented from being exposed.

The protection ink face 33*a* positioned at the leading end portion P2 of the exposed portion 13 when the print operation is completed is a rear end of the ink face necessary for transferring the protection ink onto the protection ink face 33*a*. Therefore, a length of the non-color ink portion in the conveyance direction may be longer than a length acquired by adding a length of the ink face necessary for transferring the protection ink to a length of the ink sheet exposed in the region "c".

According to the present exemplary embodiment, the length d2 of the transparent face 33*b* is extended so that the color ink portion 32 is not exposed when the print operation is completed. However, the protection ink face 33*a* may be extended.

Figure 21A:
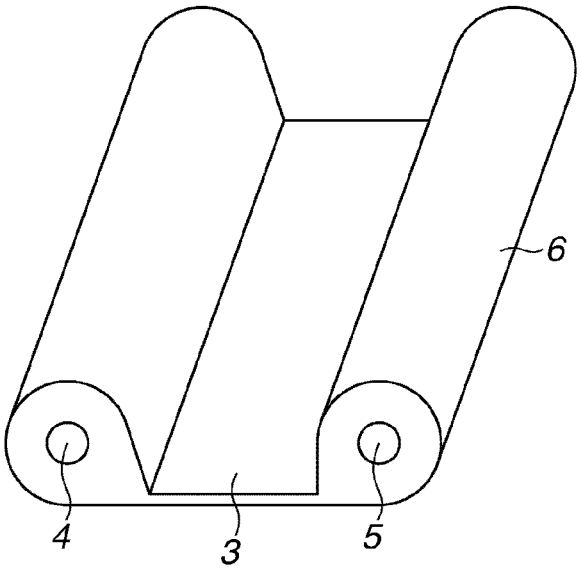
FIGS. 21A, 21B, and 21C illustrate an example of a shape of an ink ribbon cassette.

Further, according to the present exemplary embodiment, the ink cassette illustrated in FIG. 5 is explained as an example, however, the present invention may be realized with the ink cassette illustrated in FIG. 21A. The same reference numeral is given to each unit illustrated in FIG. 21 that is the same as each unit illustrated in FIG. 5. In the ink cassette illustrated in FIG. 21A, as with the ink cassette illustrated in FIG. 5, the exposed portion 13 includes an exposed portion a3 located at a side of the take-up bobbin 5 from the heating device 14 with which the ink is transferred and an exposed portion b3 located at a side of the supply bobbin 4 from the heating device 14 with which the ink is transferred (refer to FIG. 21B). The region a3 for the ink ribbon is the region where the ink has been already transferred. Thus, even if the user touches it, the print quality is not deteriorated.

Figure 21C:
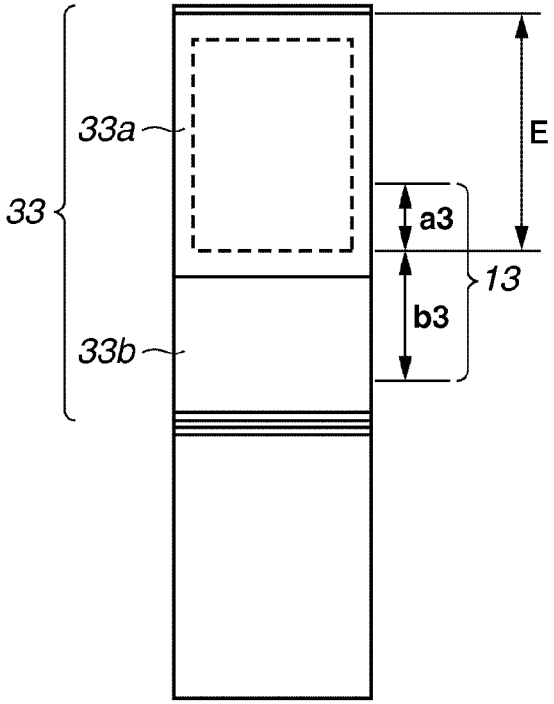
Figure 21B:
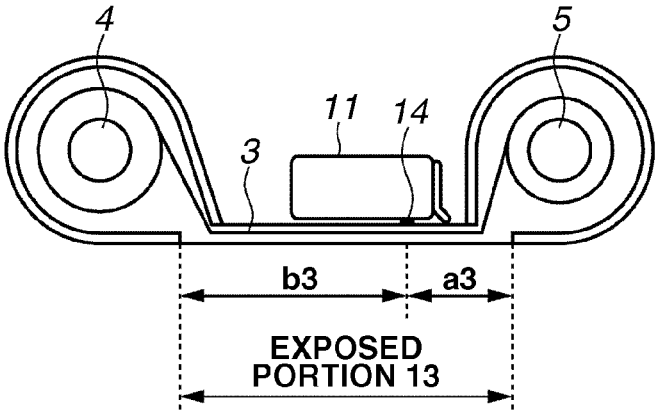

Since a region b3 at the side of the supply bobbin 4 indicates the ink ribbon to be used, if the user touches it, the print quality may have an adverse effect. Thus, as illustrated in FIG. 21C, a portion having at least a length of the exposed portion b3 from the rear end of the ink face of the non-color ink portion 33, which is used for transferring the protection ink, is the non-color ink portion. With this arrangement, when the transfer of the protection ink is completed, the color ink is not exposed from the ink cassette.

Further, as illustrated in FIG. 3, the length of the non-color ink portion 33 in the conveyance direction is extended, and the faces 32*a*, 32*b*, and 32*c* of the color face 32 is not provided with a transparent portion. This is because, if each color face is provided with the transparent portion, the ink ribbon becomes longer, thereby increasing a size of the ink cassette. The faces 32*a*, 32*b*, and 32*c* of the color face 32 and the protection ink face 33*a* have sizes necessary for transferring the ink onto paper having a specific size, and the transparent portion is provided only at a rear portion of the protection ink for finally transferring the ink in print processing. Further, even if the user touches the protection ink, since the protection ink is transparent, the color does not adhere to the user's hand.

According to the present exemplary embodiment, the protection ink is transferred onto the ink included in the ink face that is transferred onto the paper. However, when the protection ink is not used, without providing the protection ink face 33*a*, only the transparent face 33*b* longer than the exposed portion 13 may be provided to constitute the ink ribbon.

A thermal printer of a second exemplary embodiment will be described. Detailed descriptions about a configuration of the present exemplary embodiment which is the same as that of the first exemplary embodiment will be not be repeated. A configuration of the ink ribbon of the present exemplary embodiment is different from that of the first exemplary embodiment. According to the first exemplary embodiment, the length d2 (refer to FIG. 8) of the transparent face 33*b* is constant. However, according to the present exemplary embodiment, not to expose the color ink portion 32 when the print operation is completed, by having regard to the fact that the length necessary for the transparent face 33*b* varies depending on a state where the ink ribbon 3 is reeled, the length of the transparent face 33*b* is more appropriately determined.

Figure 9:
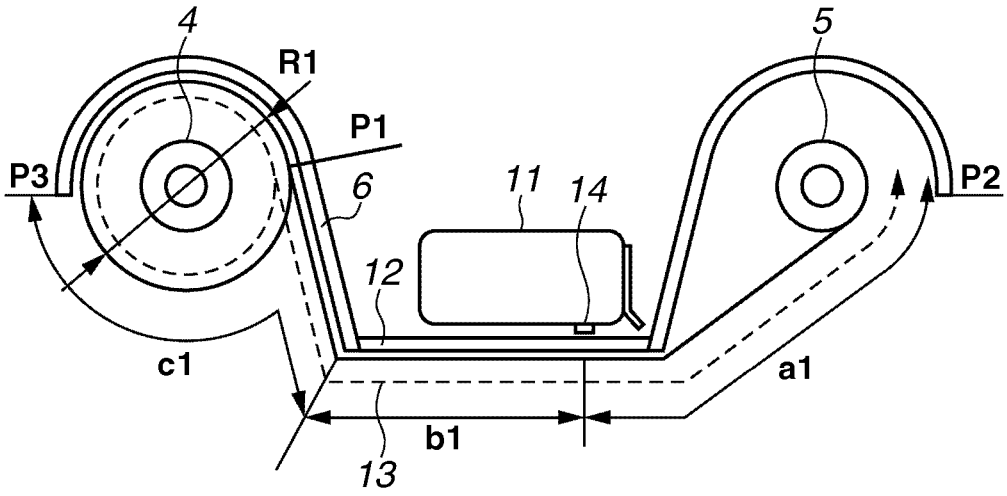
FIG. 9 is a cross-sectional view illustrating a state right after reeling of an ink ribbon is started according to the present invention.

FIG. 9 is a cross-sectional view illustrating a state right after reeling of an ink ribbon is started. The regions a1, b1, and c1 respectively correspond to the regions "a", "b", and "c" of exposed portion 13 of the ink ribbon 3 illustrated in FIG. 5.

The larger a reel diameter R1 of the ink ribbon 3 reeled by the supply bobbin 4 is, the shorter a length of the region "c" becomes. Accordingly, the length of the region c1 has the minimum value. The smaller a reel diameter R2 of the ink ribbon 3 reeled by the take-up bobbin 5 is, the shorter a length of the region "a" becomes. Accordingly, the length of the region a1 has the minimum value. Since a length of the region "b" is not affected by the reel diameters R1 and R2, they have constant values. In other words, the regions "b" and b1 have the same length.

Figure 10:
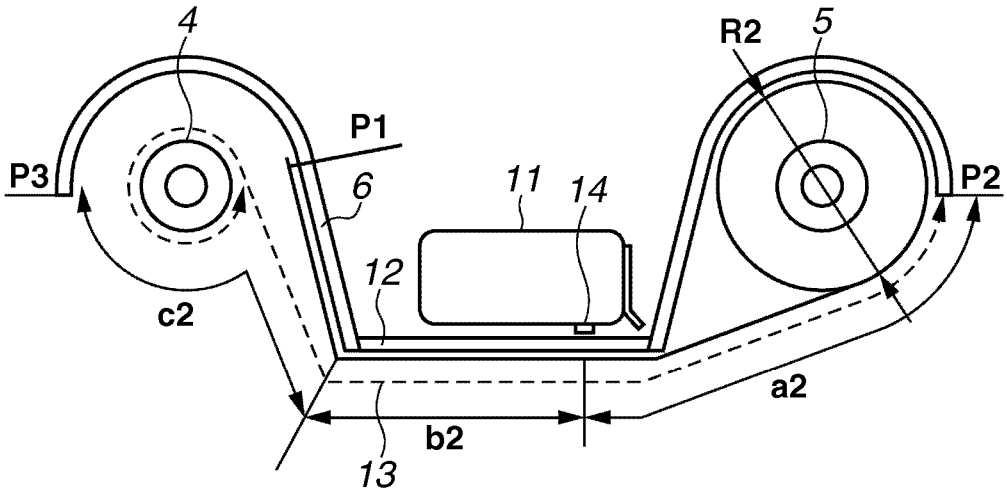
FIG. 10 is a cross-sectional view illustrating a state right after reeling of an ink ribbon is completed according to the present invention.

FIG. 10 is a cross-sectional view illustrating a state right after reeling of an ink ribbon is completed. The regions a2, b2, and c2 illustrated in FIG. 10 respectively correspond to the regions "a", "b", and "c" of the conveyance passage of the ink ribbon 3 illustrated in FIG. 5.

Since, as described above, the larger the reel diameter R1 is, the shorter the length of the region "c" becomes (the smaller the reel diameter R1 is, the longer the length of the region "c" becomes). Accordingly, the length of the region c2 has the maximum value. As described above, the smaller the reel diameter R2 is, the shorter the length of the region "a" becomes (the larger the reel diameter R2 is, the longer the length of the region "a" becomes). Accordingly, the length of the region a2 has the maximum value. As described above, since the length of the region "b" is not affected by the reel diameters R1 and R2, the regions "b" and "b2" have the same length.

Figure 11A:
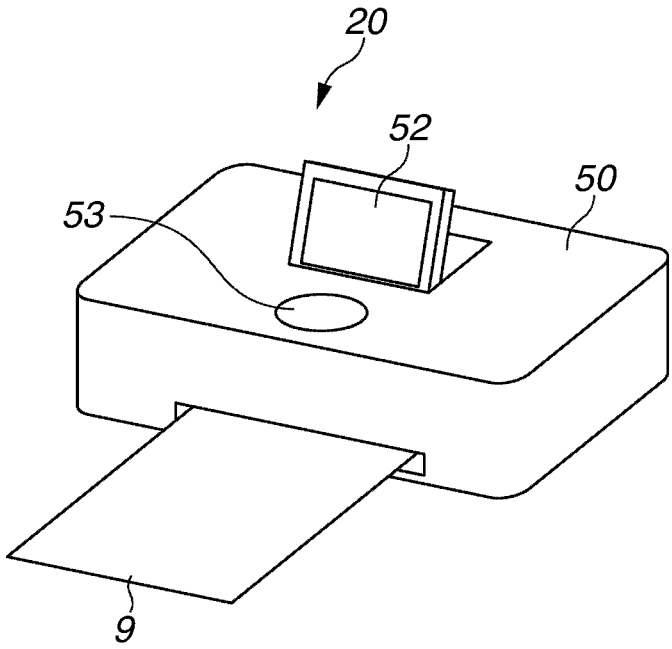
FIGS. 11A and 11B are perspective views illustrating another exemplary embodiment of a thermal printer of the present invention.
Figure 11B:
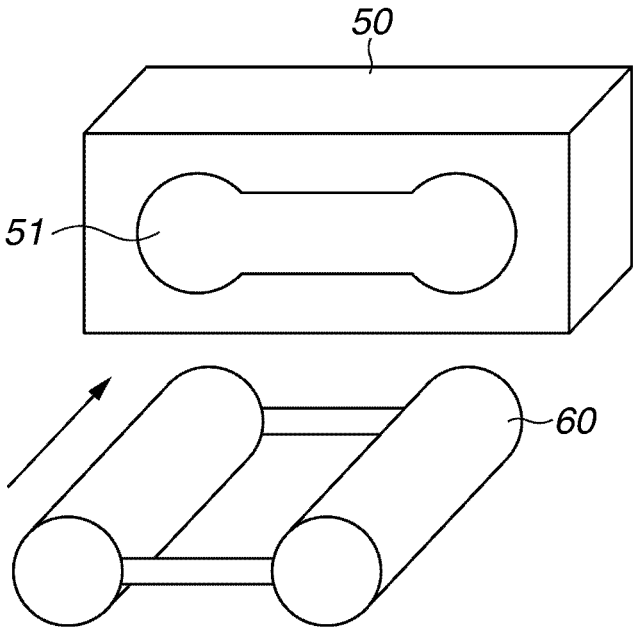

According to the present exemplary embodiment, when the reel diameter R2 is small (refer to FIG. 10), a length of the transparent face 33*b* necessary to prevent exposure of the color ink portion 32 when the print operation is completed can be shorter compared with that when the reel diameter R2 is large (refer to FIGS. 11A and 11B). By using this advantage, a length of the transparent face 33*b* is determined.

According to the present exemplary embodiment, a dimension of the transparent face 33*b* is determined by associating variation of the reel diameter R2 with variation of the number of prints. More specifically, when the ink ribbon 3 can print 50 image planes, the length of the transparent face 33*b* is 5 mm (when the number of prints is up to 10 image planes), 10 mm (11 to 30 image planes), and 20 mm (31 to 50 image planes). Thus, the total length is 650 mm. On the other hand, according to the first exemplary embodiment, since the length of the transparent face 33*b* is uniformly defined as 20 mm, the total length is 1,000 mm. Thus, according to the present exemplary embodiment, compared with the first exemplary embodiment, the whole length of the ink ribbon 3 is 350 mm shorter.

According to the present exemplary embodiment, the less the number of the prints is, the shorter the length of the transparent face 33*b* of the ink ribbon 3 becomes. More specifically, the length of the transparent face 33*b* at a front side of the ink ribbon is longer than that at a rear end side thereof. As getting closer to the rear end side in the conveyance direction, the transparent face 33*b* becomes shorter gradually in the conveyance direction. With this arrangement, compared to the first exemplary embodiment, the length of the ink ribbon 3 can be saved, thereby cutting the cost for the ink ribbon 3.

FIGS. 11A and 11B are perspective views of a thermal printer of a third exemplary embodiment. FIG. 11A is a perspective view in which a thermal printer 20 of the present exemplary embodiment is viewed from the front. FIG. 11B is a perspective view in which the thermal printer 20 illustrated in FIG. 11A is viewed from a side.

As illustrated in FIGS. 11A and 11B, the thermal printer 20 of the present exemplary embodiment includes a main body 50 and an ink ribbon cassette 60 that can be detachably attached thereto.

An insertion opening 51 through which the ink ribbon cassette 60 is inserted is provided at a side face of the main body 50. On a top face of the main body 50, a display unit 52 is provided. The display unit 52 displays a status of the main body 50 when a power unit (not illustrated) is activated. The status indicates, for example, whether the ink ribbon cassette 60 is inserted into the main body 50. Further, on the top surface of the main body 50, an operation unit 53 is provided. The operation unit 53 is used to perform operation to turn on/off the power, select an image, set printing, and transmit a print command. The ink ribbon cassette 60 can be attached/detached to/from the main body 50 using the operation unit 53.

Figure 12A:
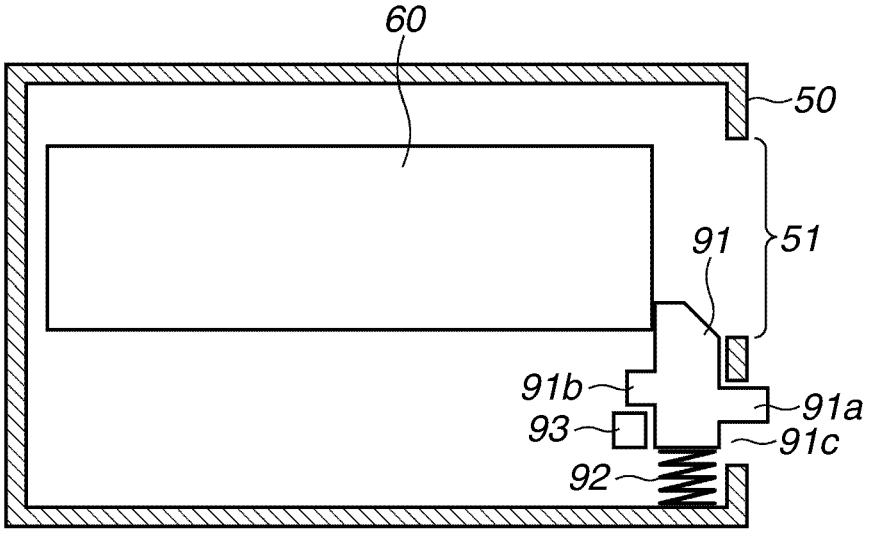
FIGS. 12A and 12B are cross-sectional views illustrating an operation for attaching an ink ribbon cassette to a main body of a thermal printer illustrated in FIGS. 11A and 11B.
Figure 12B:
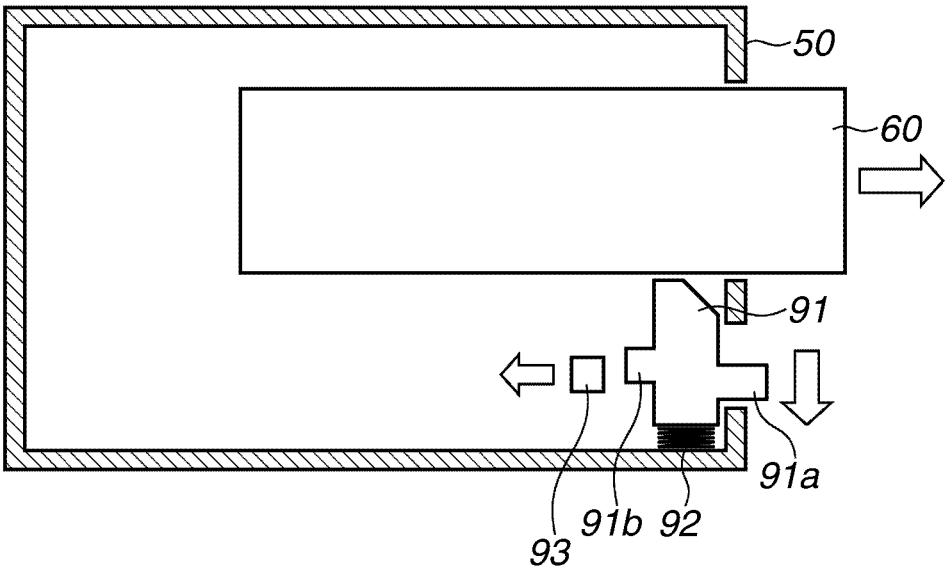

Next, with reference to FIG. 12, an operation for attaching the ink ribbon cassette 60 to the main body 50 will be described. FIG. 12A is a cross-sectional view illustrating a state where the ink ribbon cassette 60 is attached to the main body 50. FIG. 12B is a cross sectional view illustrating a state where the 60 is detachable from the main body 50.

Inside the main body 50, an engagement member 91 is disposed in the vicinity of the insertion opening 51. The engagement member 91 is provided with the engagement member 91*a* and engagement member 91*b*. The engagement member 91*a* protrudes outside from the main body 50 through an engagement member 91*c* provided at the side face of the main body 50. On the other hand, the engagement member 91*b* protrudes inside to the main body 50. A spring 92 is provided at a bottom portion of the engagement member 91. Further, a movable moving member 93 is disposed inside of the main body 50.

As illustrated in FIG. 12A, after the ink ribbon cassette 60 is stored in the main body 50 through the insertion opening 51, the engagement member 91 moves into a space between the ink ribbon cassette 60 and the insertion opening 51 under an elastic force of the spring 92. At this point, the moving member 93 moves to a first position where the moving member 93 fixes the engagement member 91. More specifically, the moving member 93 moves to a position where the moving member 93 engages with the engagement member 91*b* to prevent the engagement member 91 from dropping. When the moving member 93 moves apart from the engagement member 91 and moves to a second position where the moving member 93 releases the engagement member 91 from the fixing, and when the engagement member 91*a* is pressed, as illustrated in FIG. 12B, the ink ribbon cassette 60 is detachable from the main body 50.

Figure 13A:
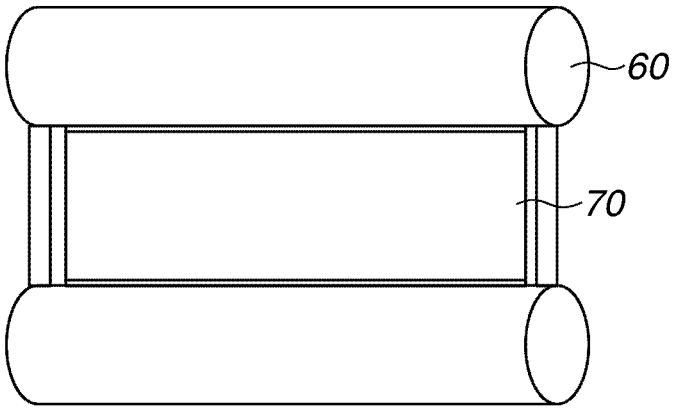
FIGS. 13A and 13B are perspective views illustrating a configuration of an ink ribbon cassette attached to the thermal printer illustrated in FIGS. 11A and 11B.
Figure 13B:
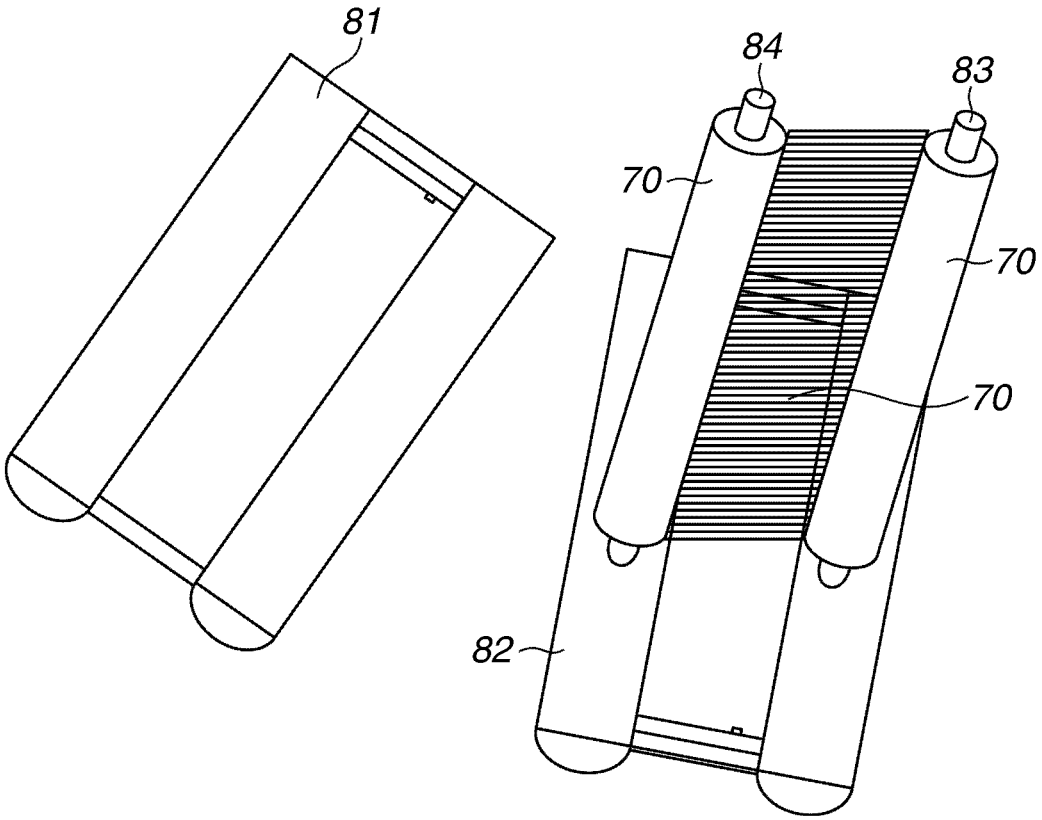

Next, with reference to FIG. 13, a configuration of the ink ribbon cassette 60 will be described. FIG. 13A is a perspective view illustrating an outer appearance of the ink ribbon cassette 60, and FIG. 13B is an exploded perspective view of the ink ribbon cassette 60. The ink ribbon cassette 60 illustrated in FIG. 13B includes a top cover 81 and a bottom cover 82 which forms a case. In the bottom cover 82, an ink ribbon 70 is mounted in a state where the ink ribbon 70 is continuously reeled by a take-up bobbin 83 and a supply bobbin 84 in a roll shape. After the mounting, the ink ribbon 70 is covered with the top cover 81, and then the ink ribbon cassette 60 is completed (refer to FIG. 13A).

Figure 14:
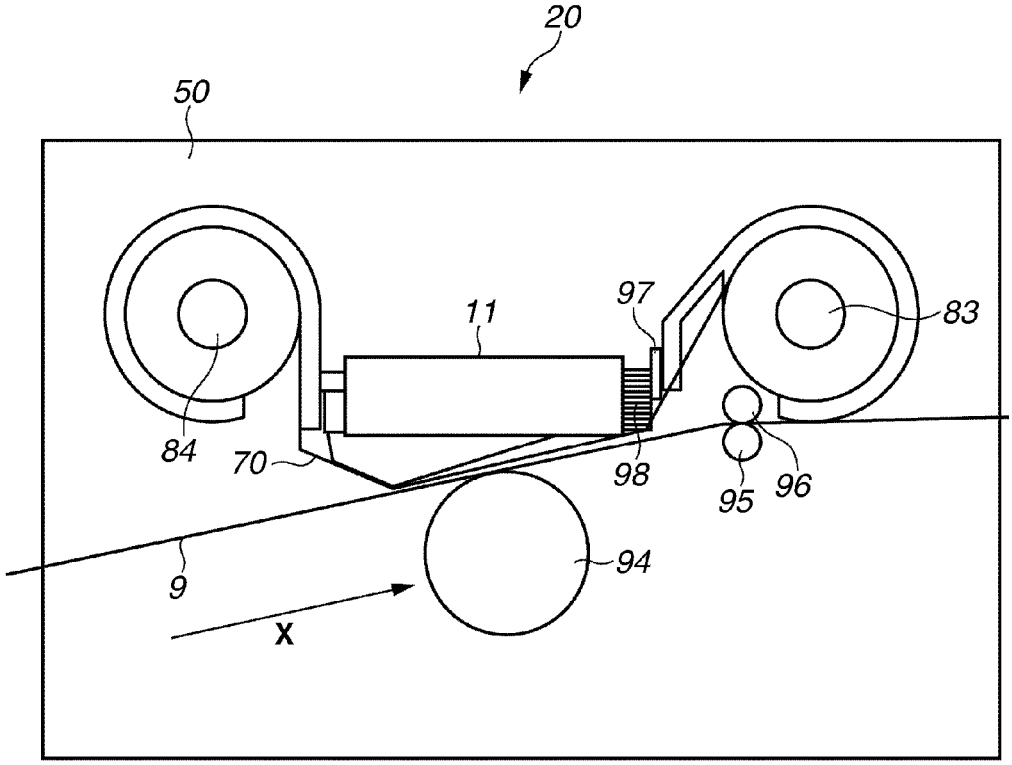
FIG. 14 is a cross-sectional view illustrating a configuration inside of the main body of the thermal printer illustrated in FIGS. 11A and 11B.

FIG. 14 is a cross-sectional view illustrating an inside of the main body of the thermal printer of the present exemplary embodiment.

The main body 50 of the thermal printer 20 of the present exemplary embodiment includes therein the thermal head 11, which is a thermal source, and a platen roller 94 opposing the thermal head 11. On a circuit substrate provided on a surface of the thermal head 11 opposing the platen roller 94, a plurality of the heating elements (not illustrated) is aligned. The platen roller 94 is rotatably supported at both ends thereof being press-contacted to the heating elements.

When the print operation is performed, the recording medium 9 and the ink ribbon 70 are press-held by the thermal head 11 and the platen roller 94. In this state, the heating elements of the thermal head 11 are heated up to thermal-transfer the ink applied on the ink ribbon 70 onto the recording medium 9, and thus printing is performed for each line. The recording medium 9 is press-held by a pair of rollers formed of a grip roller 95 and a pinch roller 96. When the print operation is performed, the recording medium 9 is conveyed being driven by rotation of the grip roller 95 in the conveyance direction (X direction illustrated in FIG. 14) of the recording medium 9. At this point, the take-up bobbin 83 is rotated. By this rotation, the ink ribbon 70 is drawn from the supply bobbin 84, conveyed in the X direction, and then reeled by the take-up bobbin 83.

In synchronization with the conveyance of the recording medium 9 and the ink ribbon 70, the heating elements of the thermal head 11 are repeatedly heated up so that a line-pattern image is transferred in the conveyance direction (X direction) to form an image.

Above the exposed portion of the ink ribbon 70 from the thermal head 11 to the take-up bobbin 83, a marker sensor 97 is disposed. The marker sensor 97 is an optical sensor and detects pass of the ribbon marker formed on the ink ribbon 70 by detecting a change of a level of received light.

As illustrated in FIG. 14, the conveyance passage of the recording medium 9 and that of the ink ribbon 70 are separated from each other in the middle. Until the separation, the recording medium 9 and the ink ribbon 70 adhere to each other, and at the time of separation, they are peeled from each other. As a starting point for the separation, a separation member 98 is provided at a side of the ink ribbon 70. The conveyance passage of the ink ribbon 70 bends toward the conveyance passage of the recording medium 9 starting from the separation member 98 as the original point.

Next, with reference to FIG. 15, a configuration of the ink ribbon 70 will be described. The ink ribbon 70 has a similar configuration to that of the ink ribbon 3 illustrated in FIGS. 3 and 4. The ink ribbon 70 are alternately formed of a color ink portion 71 and a non-color ink portion 72 in the conveyance direction (refer to an arrow 200) of the ink ribbon 70. The color ink portion 71 illustrated in FIG. 15 includes ink faces in yellow, magenta, and cyan, however, the ink face may have a single color. The protection ink is applied onto the non-color ink portion 72 similarly to that of the ink ribbon 3, and the protection ink is transferred after the whole color ink portion 71 are completely transferred for one image.

According to the present exemplary embodiment, as illustrated in FIG. 14, the ink ribbon 70 is continuously reeled by the supply bobbin 84 and the take-up bobbin 83 with the color ink portion 71 facing the inside. Further, similarly to the ink ribbon 3, the non-color ink portion 72 of the ink ribbon 70 is longer than that of the exposed portion of the ink ribbon 70 between the supply bobbin 84 and the take-up bobbin 83. According to the present exemplary embodiment, the exposed portion of the ink ribbon 70 is not covered by a portion positioned backward in the conveyance direction of the ink ribbon 70 reeled by the supply bobbin 84. Further, the exposed portion of the ink ribbon 70 is not covered by a portion positioned forward in the conveyance direction of the ink ribbon 70 reeled by the take-up bobbin 83. Furthermore, the exposed portion of the ink ribbon 70 is not covered by the case (top cover 81 and bottom cover 82).

On the ink ribbon 70, a ribbon marker 73*a* which is similar to the ribbon marker 35*a* is formed at a boundary between a rear end portion of the color ink portion 71 positioned backward in the conveyance direction and a front end portion of the non-color ink portion 72 positioned behind the rear end portion of the color ink portion 71 in the conveyance direction. Further, at a boundary between the rear end portion of the color ink portion 71 positioned backward in the conveyance direction and the front end portion of the non-color ink portion 72 positioned behind the rear end portion of the color ink portion 71 in the conveyance direction, as well as at a boundary between ink faces in the color ink portion 71, a ribbon marker 73*b* of a different kind from the ribbon marker 73*a* is formed. The ribbon markers 73*a* and 73*b* are used to detect the face on which the transfer is completed.

Figure 16:
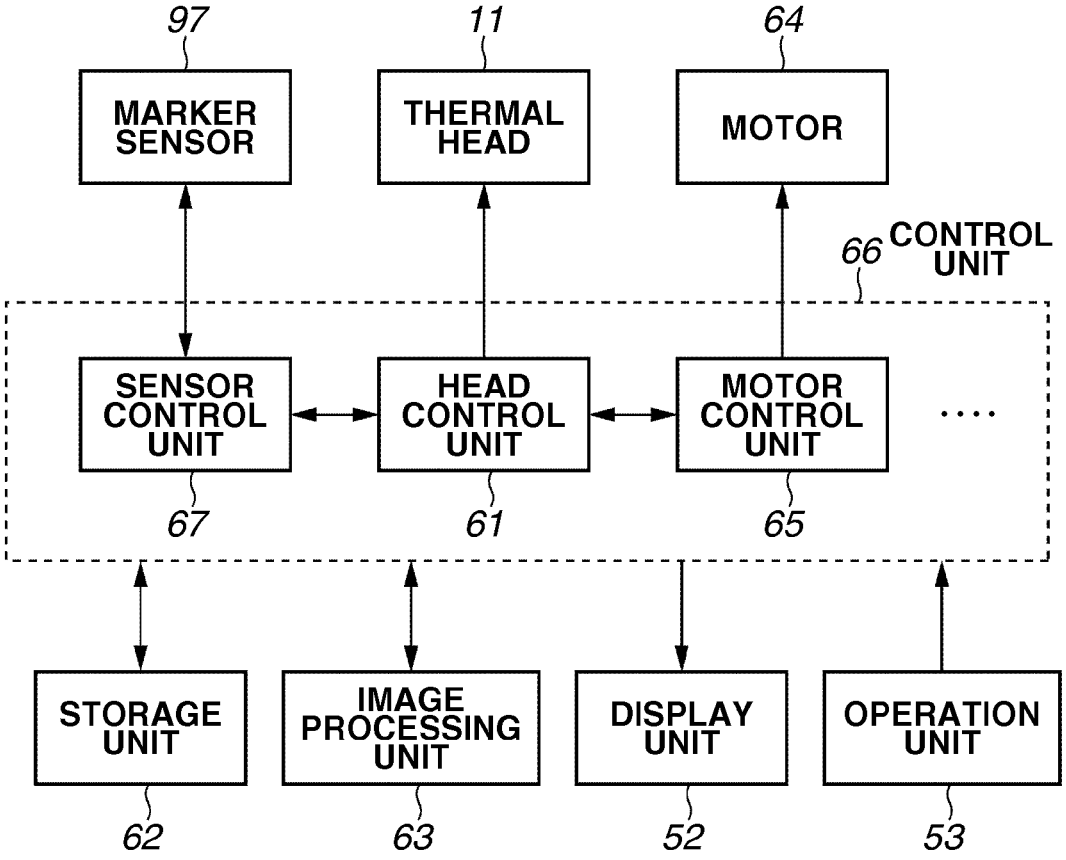
FIG. 16 is a block diagram illustrating a configuration of control of a print operation provided inside of a main body of the thermal printer illustrated in FIGS. 11A and 11B.

Next, a configuration for controlling the print operation performed by the thermal printer of the present exemplary embodiment will be described. FIG. 16 is a block diagram illustrating a configuration of the control of the print operation provided inside a main body of the thermal printer of the present exemplary embodiment.

The main body 50 includes a control unit 66 connected to the operation unit 53 and the display unit 52. The control unit 66 includes a head control unit 61, a motor control unit 65, and a sensor control unit 67. The head control unit 61 controls an operation of the thermal head 11. The motor control unit 65 controls an operation of a motor 64 that rotates the take-up bobbin 83. The sensor control unit 67 controls an operation of the marker sensor 97. Further, the main body 50 includes the storage unit 62 and the image processing unit 63 that are connected to the control unit 66. The storage unit 62 stores various kinds of data such as the number of the ribbon markers in the ink ribbon 70 detected by the marker sensor 97. The image processing unit 63 converts image data to be printed into data based on CMY indicating density of each color of cyan, magenta, and yellow to perform image correction.

Next, processing of the print operation performed by the thermal printer of the present exemplary embodiment is described.

Figure 17:
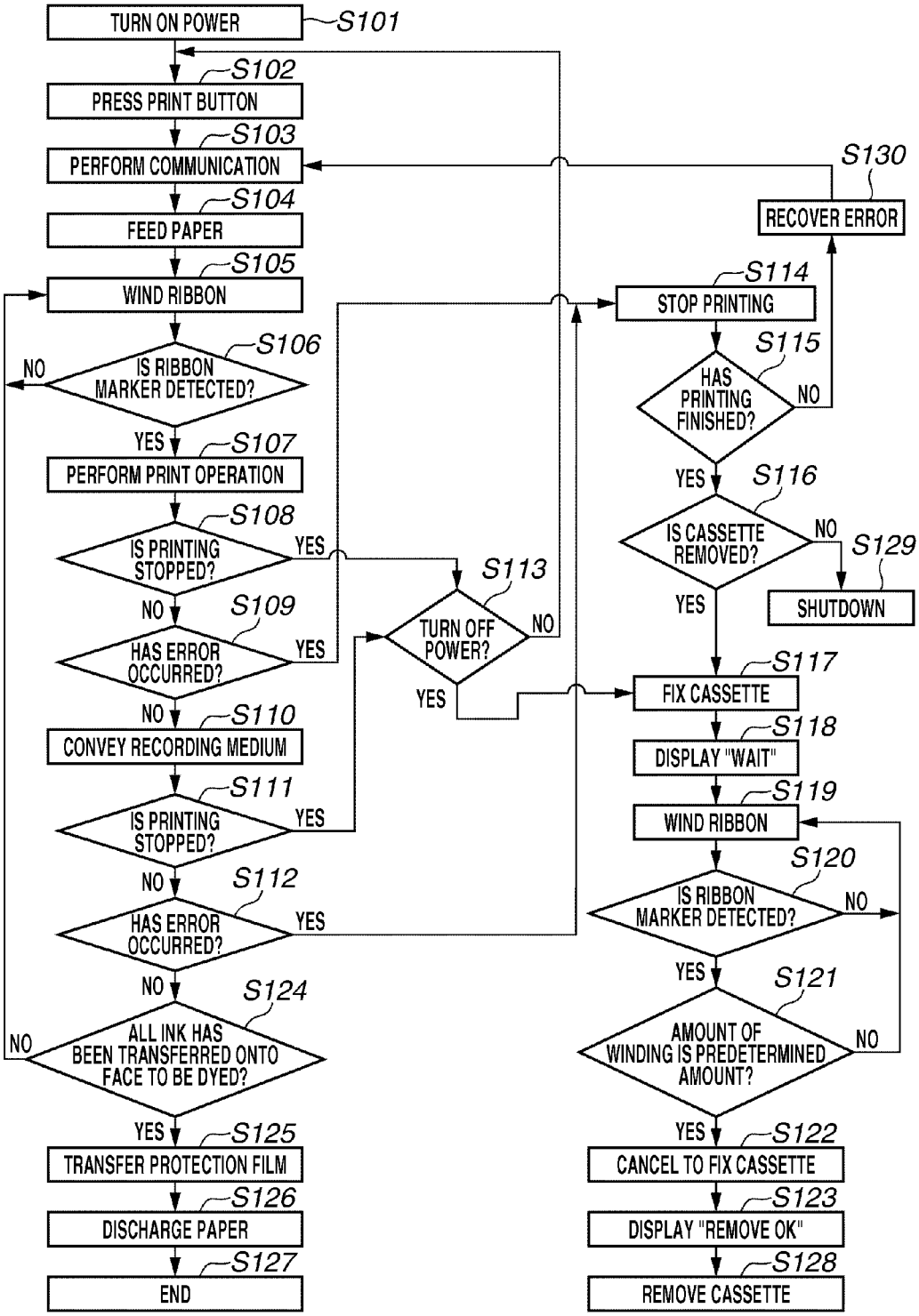
FIG. 17 is a flowchart illustrating processing of a print operation performed by a thermal printer of a third exemplary embodiment.

FIG. 17 is a flowchart illustrating processing of the print operation performed by the thermal printer of the present exemplary embodiment.

In a flowchart illustrated in FIG. 17, in step S101, the power of the thermal printer 20 is turned on via the operation unit 53. In step S102, a command for starting printing is issued, and, in step S103, communication is performed between the operation unit 53 and the control unit 66. In step S104, the recording medium 9 is fed. The "feeding the paper" herein refers to conveyance of the recording medium 9 made by the control unit 66 so that a position for starting printing on the recording medium 9 is located right below the heating elements of the thermal head 11. Further, the command for starting printing is issued when the print button (not illustrated) provided for the operation unit 53 is pressed.

Following step S104, in step S105, a reeling operation of the ink ribbon 70 is performed. The reeling operation herein refers to rotation of the take-up bobbin 83 driven by the motor control unit 65 via the motor 64 so that the transfer of the ink applied on the color ink portion 71 of the ink ribbon 70 onto the supply bobbin 4 is started. With this arrangement, the ink ribbon 70 is reeled by the take-up bobbin 83. In step S106, when the ink ribbon 70 is reeled, the sensor control unit 67 detects whether the ribbon marker 73*b* located right before the ink portion to be transferred has passed the marker sensor 97. When the ribbon marker 73*b* has not passed yet (NO in step S106), the operation of step S105 is performed until it passes.

When the marker sensor 97 detects that the ribbon marker 73*b* has passed (YES in step S106), it is notified to the sensor control unit 67 that the ribbon marker 73*b* has passed. In step S107, the transfer onto the recording medium 9 performed by the thermal head 11 under control of the head control unit 61 is started. In step S108, during the transfer, the head control unit 61 detects whether the operation unit 53 has determined to stop the print operation. When the print operation is not to be stopped (No in step S108), the transfer is processed, and, in step S109, the head control unit 61 detects whether an error occurs during the transfer. This error includes, for example, an overloading state of the motor 64 due to the stuck ink ribbon 70.

Following step S109, in step S110, the recording medium 9 is backward conveyed (to convey the recording medium 9 in a direction opposite to the "X" direction) to transfer the next ink portion. During the backward conveyance of the recording medium 9, the head control unit 61 detects determination of stopping printing in step S111 and the occurrence of the error in step S112. When the head control unit 61 detects none (NO in steps S111 and S112), in step S124, it is determined whether the transfer of the color ink portion 71 necessary for printing has been completely transferred. As a determination method, the sensor control unit 67 makes the storage unit 62 store the number of the ribbon markers detected by the marker sensor 97 since the transfer for printing an image has been started. When, in step S124, printing the color ink portion 71 is completed, in step S125, the protection ink applied on the protection ink face 72 is transferred. When the transfer of the protection ink is completed without any error, and if the ink cassette as described in the first and second exemplary embodiments is adopted, the exposed portion is the non-color ink portion. Thus, after the protection ink is transferred, the ink ribbon is not conveyed. The ink ribbon is conveyed when, as in step S102, the print button is pressed again to input the instruction of the next print operation. After the protection ink is transferred, in step S126, the recording medium 9 is discharged and, in step S127, a series of print operation is completed.

When the print operation or the backward conveyance operation of the recording medium 9 is stopped via the operation unit 53 in step S108 or S111, in step S113, whether to turn off the power of the main body 50 is determined. More specifically, the head control unit 61 determines whether the command for turning off the power is input via the operation unit 53. When the power is not turned off (No in step S113), the operation is fed back to step S102. When the error occurs in step S109 or S112, in step S114, the head control unit 61 stops the transfer operation or the backward conveyance operation of the recording medium 9.

In step S115, the head control unit 61 makes the display unit 52 perform the display for prompting to select whether or not to finish the printing, and then the user selects either one via the operation unit 53. When the printing is continued (No in step S115), in step S130, error recovery is performed depending on content of the error, and in step S103, communication for performing the transfer operation again is performed. When, in step S115, finishing the print operation is selected, in step S116, the head control unit 61 determines via the operation unit 53 whether the ink ribbon 70 is detachable.

When it is determined that ink ribbon 70 is detachable (YES in step S116), in step S117, the head control unit 61 holds the moving member 93 at the first position to fix the ink ribbon cassette 60. In step S118, the head control unit 61 makes the display unit 52 perform a first display for indicating that the ink ribbon cassette 60 is not detachable. According to the present exemplary embodiment, "WAIT" is displayed on the display unit 52 as the first display. In step S119, the reeling operation of the ink ribbon 70 is started. During this reeling operation, in step S120, the sensor control unit 67 determines whether the marker sensor 97 has detected the ribbon marker 73*b* formed at the boundary between the rear end portion of the color ink portion 71 and the front end portion of the non-color ink portion 72.

When the ribbon marker 73*b* is not detected, the motor control unit 65 makes the take-up bobbin 83 reel the ink ribbon 70 via the motor 64 until the ribbon marker 73*b* is detected. Afterward, when the ribbon marker 73*b* is detected, in step S121, the motor control unit 65 determines whether an amount of rotation of the thermal printer 10 after the ribbon marker 73*b* is detected has reached a predetermined amount. More specifically, until the amount of the rotation reaches the set amount of rotation with reference to a position where the ribbon marker 73*b* is detected, the motor control unit 65 rotates the take-up bobbin 83. In step S121, the ink ribbon 70 is reeled up to a stop position where the exposed portion is formed of the non-color ink portion 72.

Figure 15:
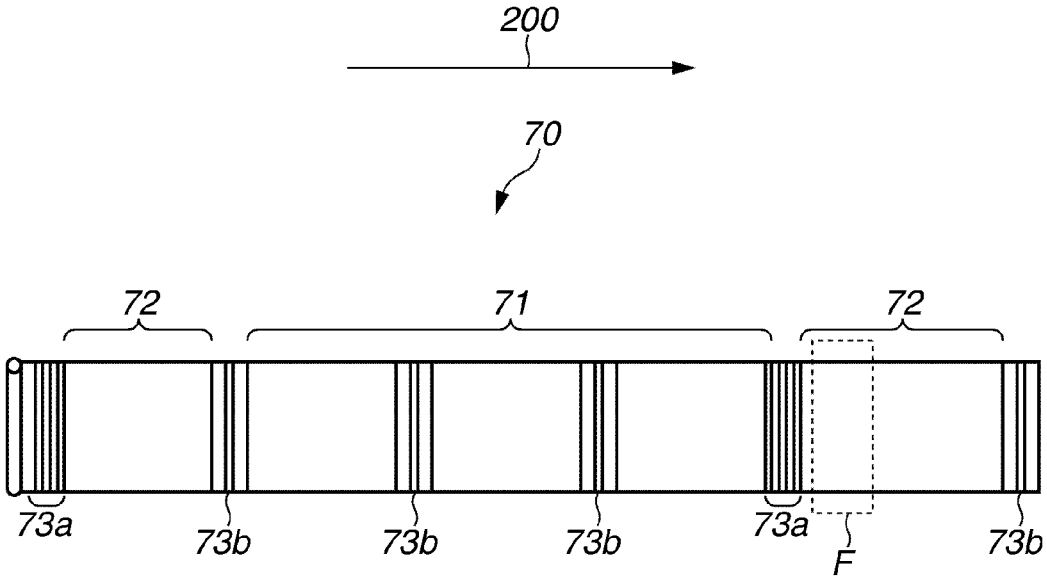
FIG. 15 is a top plan view illustrating a configuration of an ink ribbon provided in the ink ribbon cassette illustrated in FIG. 13.

Therefore, the maximum value of the amount of the rotation of the take-up bobbin 83 is a necessary value so that a region "F" illustrated in FIG. 15 becomes the exposed portion of the ink ribbon 70. In this case, the rear end portion of the non-color ink portion 72 is located at the rear end portion of the exposed portion. The minimum value of the amount of the rotation of the take-up bobbin 83 is a necessary value for conveying the ribbon marker 73*b* detected in step S121 to the leading end portion of the exposed portion. The less the amount of the rotation of the take-up bobbin 83, the shorter the time necessary for the operation in step S121. The amount of reeling non-color ink portion 72 can be determined by a rotation rate and time of the take-up bobbin 83, however, the present invention is not limited thereto.

After a predetermined amount of reel is finished, the head control unit 61 moves the moving member 93 to the second position. With this movement, in step S122, the ink ribbon cassette 60 is released from fixing. After that, in step S123, the head control unit 61 makes the display unit 52 perform a second display indicating that the ink ribbon cassette 60 is detachable. According to the present exemplary embodiment, "DETACHMENT OK" is displayed on the display unit 52 as the second display.

Further, in step S108 or step S111, the print operation or the backward conveyance operation of the recording medium 9 is stopped via the operation unit 53, and, in step S113, when the user operates the operation unit 53 to turn off the power, the operation of step S117 described above is performed. Hereinafter, similarly to the operation described above, the ink ribbon 70 is reeled.

According to the present exemplary embodiment, when the error occurs during the print operation, the operation of reeling the ink ribbon 70 is performed so that the exposed portion of the ink ribbon 70 is formed of the non-color ink portion 72. After that, the ink ribbon cassette 60 becomes detachable from the main body 50. Therefore, even when the error occurs in the middle of the print operation, the color ink portion 71 can be prevented from being exposed when replacing the ink ribbon 70.

A thermal printer of a fourth exemplary embodiment will be described. The thermal printer of the present exemplary embodiment is similar to the thermal printer 20 of the third exemplary embodiment except for a difference of processing of the print operation. Thus, details of a portion overlapping with the item described in the third exemplary embodiment will not be repeated.

Figure 18:
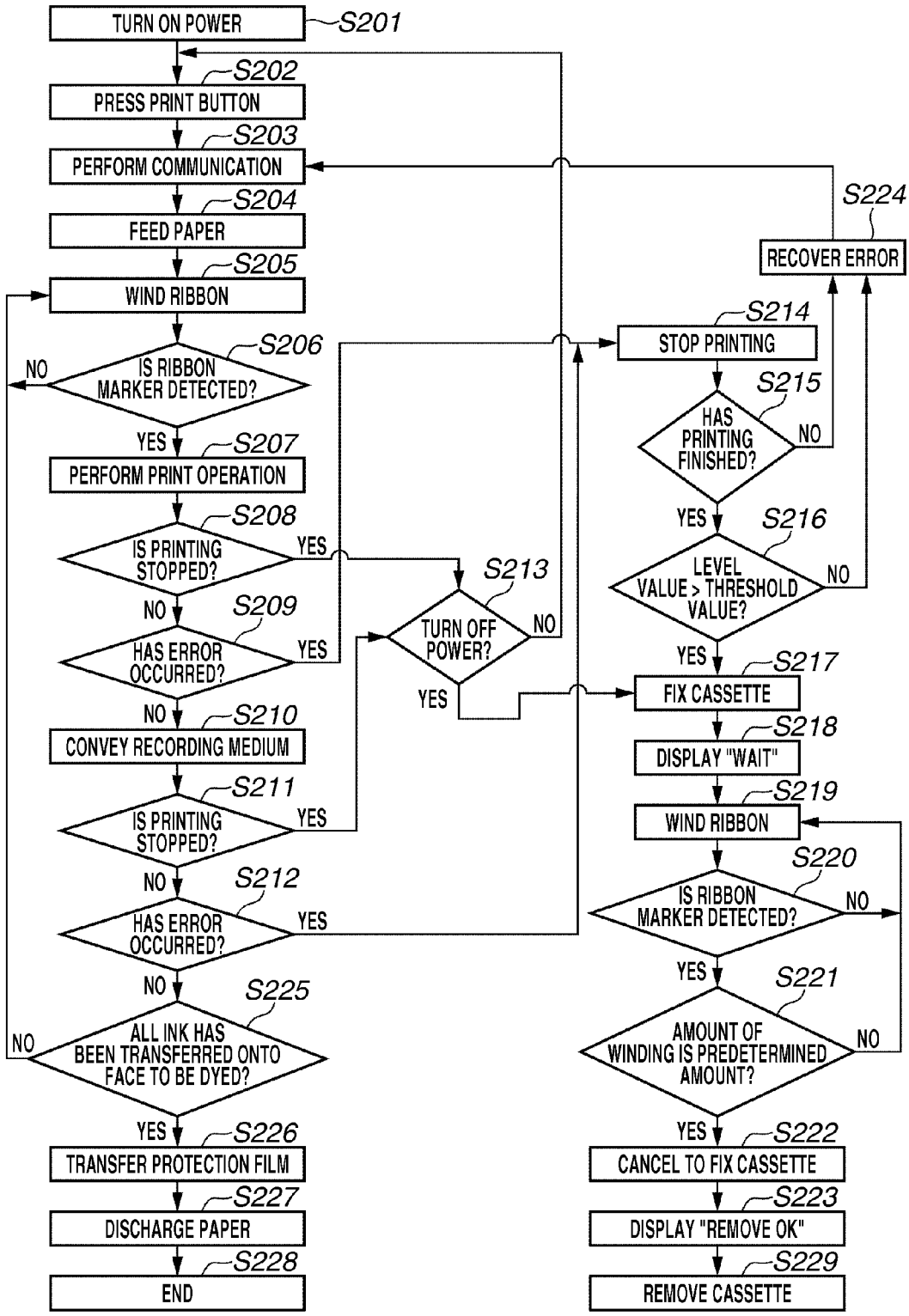
FIG. 18 is a flowchart illustrating processing of a print operation performed by a thermal printer of a fourth exemplary embodiment.

FIG. 18 is a flowchart illustrating processing of the print operation of the thermal printer of the present exemplary embodiment. Since the operation processing when no error occurs is similar to that of the third exemplary embodiment, the description of the operation processing will not be repeated.

In steps S209 and S212, when the error occurs during the transfer operation or the backward conveyance operation of the recording medium 9, in step S214, the print operation is stopped. In step S215, the head control unit 61 makes the display unit 52 perform the display for prompting to select whether or not to finish the printing, and then the user selects either one via the operation unit 53. When finishing the printing is selected in step S215, in step S216, the head control unit 61 compares a level value of the error with a threshold value. The image processing unit 63 stores data indicating the level value of the error.

When detecting the error, the head control unit 61 reads the level value of the detected error from the data stored in the storage unit 63 and compares the read value with the threshold value. When the level value of the error is smaller than the threshold value (when the content of the error is not serious), in step S224, the error recovery is performed. When the level value of the error is larger than the threshold value (when the content of the error is serious), in step S217, the head control unit 61 holds the moving member 93 at the above-described first position to fix the ink ribbon cassette 60.

In step S218, the head control unit 61 makes the display unit 52 perform the above-described first display and, in step S219, the operation of reeling the ink ribbon 70 is started. The serious error includes, for example, the error in which the ink ribbon 70 is stuck in the main body 50 and cannot be reeled. Further, content of the reel operation (operations from step S219 to step S229) of the ink ribbon 70 is similar to that described in the third exemplary embodiment, and the description will not be repeated.

According to the present exemplary embodiment, when the error in which the ink ribbon 70 needs to be replaced occurs during the print operation, the operation of reeling the ink ribbon 70 is performed such that the exposed portion of the ink ribbon 70 is formed of the non-color ink portion 72. With this arrangement, since the reel operation is not performed when the error occurs in which the ink ribbon 70 does not need to be replaced, it can be appropriately determined whether the operation of reeling the ink ribbon 70 can be performed when the error occurs.

A thermal printer of a fifth exemplary embodiment will be described. The thermal printer of the present exemplary embodiment is similar to the thermal printer 20 of the third exemplary embodiment except for a difference of the processing of the print operation. Thus, details of a portion overlapping with the item described in the third exemplary embodiment will not be repeated.

Figure 19:
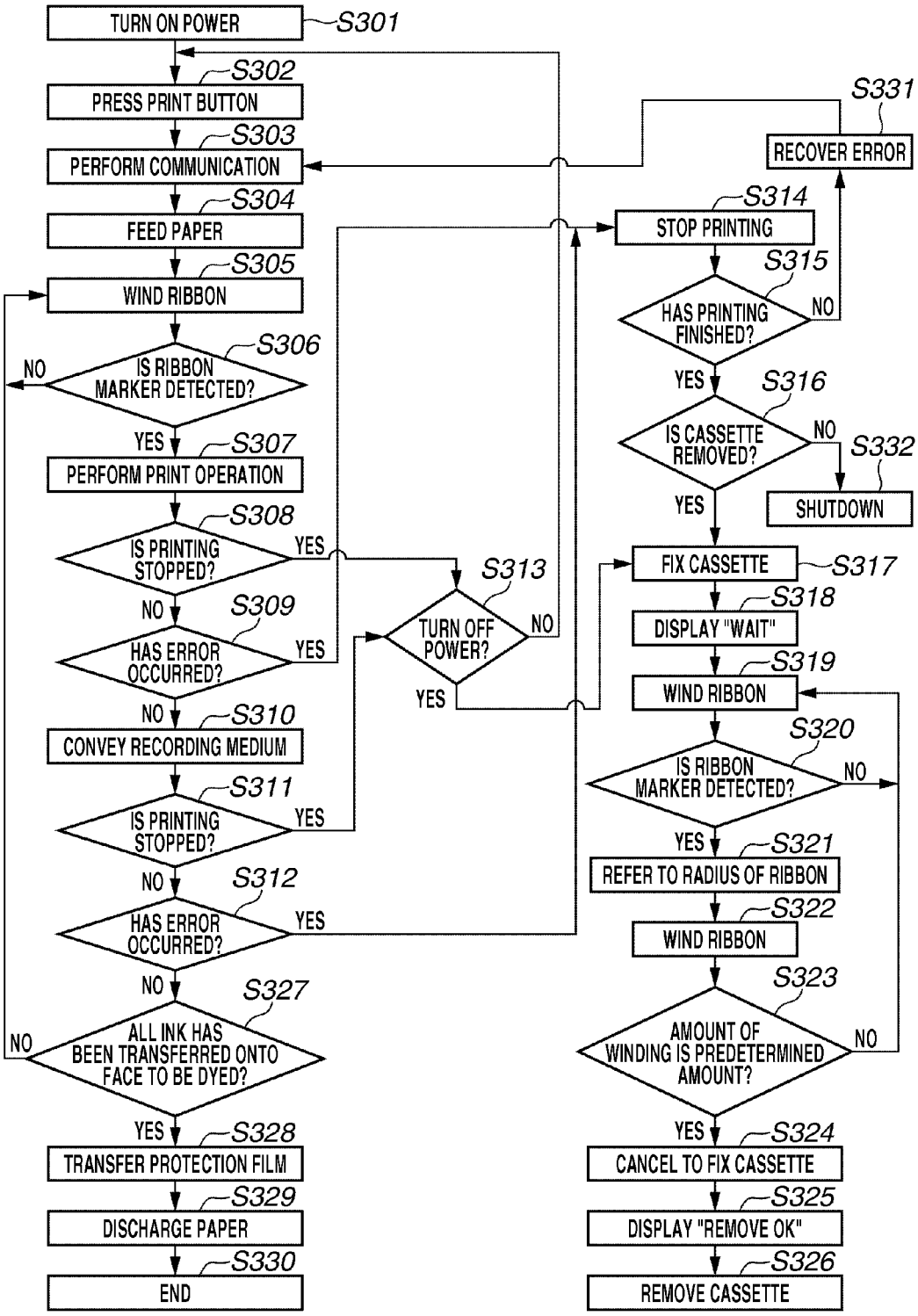
FIG. 19 is a flowchart illustrating processing of a print operation performed by a thermal printer of a fifth exemplary embodiment.

FIG. 19 is a flowchart illustrating processing of the print operation performed by the thermal printer of the present exemplary embodiment. Since the operation processing when no error occurs is similar to that of the third exemplary embodiment, the operation processing when no error occurs will not be repeated.

In step S309 or S312, when the error occurs during the transfer operation or the backward conveyance operation of the recording medium 9, in step S314, the print operation is stopped. In step S315, the head control unit 61 makes the display unit 52 perform the display for prompting to select whether or not to finish the printing, and then the user selects either one via the operation unit 53. When finishing the printing is selected in step S315, in step S319, the operation of reeling the ink ribbon 70 is started.

In step S320, for this reel operation, first, the sensor control unit 67 determines whether the marker sensor 97 has detected the ribbon marker 73*b* formed at a boundary between the rear end portion of the color ink portion 71 and the front end portion of the non-color ink portion 72. When the ribbon marker 73*b* is detected, an amount of rotation of the take-up bobbin 83 necessary for reeling the ink ribbon 70 up to the above-described stop position is calculated. A method for calculating the amount of the rotation will be described with reference to FIG. 20.

Figure 20:
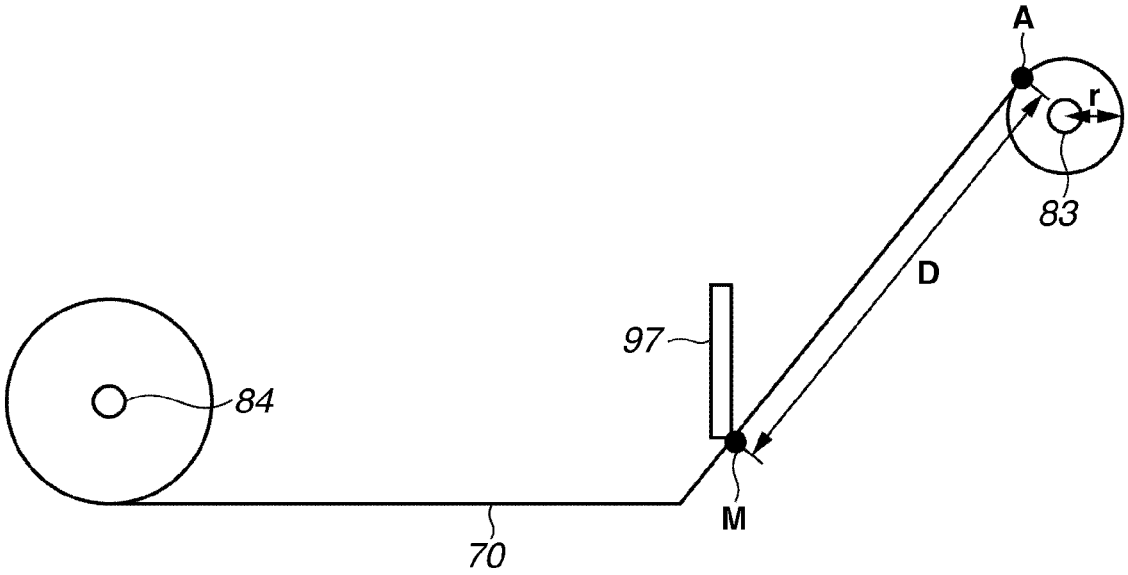
FIG. 20 is a cross-sectional view illustrating an amount of reel necessary for reeling an ink ribbon up to a position where the ink ribbon is stopped according to the fifth exemplary embodiment.

FIG. 20 is a cross-sectional view illustrating an amount of reeling the ink ribbon 70 up to the stop position. FIG. 20 illustrates a state where the ribbon marker 73*b* formed at the boundary between the rear end portion of the color ink portion 71 and the front end portion of the non-color ink portion 72 is located right beneath the marker sensor 97. In FIG. 20, a radius "r" indicates a radius of a reel circle of the ink ribbon 70 formed on the take-up bobbin 83, a contact point "A" indicates a contact point (leading end portion of the exposed portion of the ink ribbon 70) of the reel circle and the ink ribbon 70, and a contact point "M" indicates a contact point of the marker sensor 97 and the ink ribbon 70.

In step S321, with reference to data recorded in the storage unit 63, the motor control unit 65 calculates the radius "r" when the ribbon marker 73*b* is detected and a distance "D" from the contact point "A" to the contact point "M". According to the present exemplary embodiment, the motor control unit 65 calculates a value of the radius "r" and a value of the distance "D" from the number of the detected ribbon markers 73*b* stored in the storage unit 63 during the print operation. The more the detected number of the ribbon marker 73*b* is, the longer the radius "r" and the distance "D" become and, on the other hand, the smaller the number of the detected ribbon markers 73*b* is, the shorter the radius "r" and the distance "D" become. In other words, the radius "r" and the distance "D" correspond to the number of the detected ribbon marker 73*b*. The method for calculating the radius "r" is not limited thereto.

After the radius "r" and the distance "D" are calculated, in step S322, the operation of reeling the ink ribbon 70 is performed again and, in step S323, the motor control unit 65 determines whether the amount of reeling the ink ribbon 70 has reached the predetermined amount. More specifically, the motor control unit 65 determines whether the amount of the rotation of the take-up bobbin 83 has reached the amount of the rotation corresponding to the total length of the peripheral length $2\pi r$ of the outer periphery of the reel circle and the distance "D". When, in step S323, the predetermined amount of the reel has been performed (YES in step S323), in steps S324, S325, and S326, the ink ribbon cassette 60 is detachable. When, in step S323, the predetermined amount of the reel has not been performed (NO in step S323), the processing returns to step S319 to perform the operation of reeling the ink ribbon 70 again. Thus, when the sufficient amount of the reel has not been performed, the reel operation is performed up to the predetermined reel amount described above.

According to the present exemplary embodiment, when the error occurs in the middle of the print operation, the amount of reeling the ink ribbon 70 (rotation amount of the take-up bobbin 83) is determined depending on a state of reeling of the ink ribbon 70 at the time. Therefore, when locating the non-color ink portion 72 at the exposed portion of the ink ribbon 70, the ink ribbon 70 can be prevented from being unnecessarily reeled.

Further, according to the present exemplary embodiment, the ink ribbon 70 is reeled by the take-up bobbin 83 with the color ink portion 71 facing the inside. Thus even if the color ink portion 71 on which the ink remains is reeled by the take-up bobbin 83, the color ink portion 71 can be prevented from being exposed.

Other Exemplary Embodiment

A plurality of exemplary embodiments has been described and further, the described exemplary embodiments may be combined with one another to be performed.

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment (s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2010-146185 filed Jun. 28, 2010, which is hereby incorporated by reference herein in its entirety.

What is claimed is:

1. A thermal printer that transfers color ink onto recording paper, the thermal printer comprising:

a mounting unit configured to mount a detachable ink cassette on the thermal printer, the ink cassette including an ink ribbon on which a color ink portion with the color ink applied thereon and a non-color ink portion with no color ink applied thereon are alternately formed in a conveyance direction, a supply bobbin on which the ink ribbon whose color ink is to be transferred by the thermal printer is wound, a take-up bobbin on which the ink ribbon drawn from the supply bobbin is wound, and a housing that supports the supply bobbin and the take-up bobbin being apart from each other so that the ink ribbon is exposed between the supply bobbin and the take-up bobbin; and a ribbon transfer unit configure to, when an error occurs during transferring of the color ink, convey the ink ribbon so that the exposed portion of the ink ribbon is the non-color ink portion.

2. The thermal printer according to claim 1, wherein the non-color ink portion includes a portion on which transparent ink is applied or a portion on which the ink is not applied.

3. The thermal printer according to claim 1, further comprising a marker detection unit configured to detect a marker provided at a leading portion of the color ink portion of the ink ribbon or at a leading portion of the non-color ink portion thereof, and wherein the ribbon conveyance unit determines an amount of conveying the ink ribbon based on the marker detected by the marker detection unit.

4. The thermal printer according to claim 1, wherein the ribbon conveyance unit, after the error occurs during transferring of the color ink, and when the ink cassette is detached from the mounting unit, the ink ribbon is conveyed such that the exposed portion of the ink ribbon is the non-color ink portion.

5. The thermal printer according to claim 1, wherein the non-color ink portion includes a portion onto which transparent ink is applied to protect the color ink transferred onto the recording paper, and wherein the ribbon conveyance unit, when no error occurs, after the color ink and the transparent ink are transferred, does not convey the ink ribbon, but according to an instruction for starting a next transfer, conveys the ink ribbon.

6. The thermal printer according to claim 5, a plurality of color inks are applied onto the color ink portion and the non-color ink portion is larger than the color ink portion for one color.

7. The thermal printer according to claim 1, wherein the non-color ink portion includes a portion on which the transparent ink is applied to protect the color ink transferred onto the recording paper, and wherein a length of the non-color ink portion in a conveyance direction is longer than a length acquired by adding a length necessary for transferring the transparent ink to a length from a position at which the transparent ink is transferred, to a position at which the transparent ink is not exposed from the ink cassette at a side of the supply bobbin.

8. The thermal printer according to claim 1, wherein the non-color ink portion at a leading end side in the conveyance direction of the ink ribbon is larger than the non-color ink portion at a rear end side in the conveyance direction thereof.

9. An ink cassette that is detachably attached to a thermal printer that transfers ink of an ink ribbon onto recording paper by a thermal head, the ink cassette comprising:

an ink ribbon on which a color ink portion with color ink applied thereon and a non-color ink portion with no color ink applied thereon are alternately formed in a conveyance direction;

a supply bobbin on which the ink ribbon whose color ink is to be transferred by the thermal printer is wound;

a take-up bobbin on which the ink ribbon drawn from the supply bobbin is wound; and a housing configured to support the supply bobbin and the take-up bobbin being apart from each other so that the ink ribbon is exposed between the supply bobbin and the take-up bobbin, wherein the color ink portion includes a plurality of color inks applied thereon, and the non-color ink portion is larger than the color ink portion for one color.

10. An ink cassette according to claim 9, wherein the non-color ink portion is a portion with transparent ink applied thereon or a portion with no ink applied thereon.

11. The ink cassette according to claim 9, wherein the non-color ink portion includes a portion on which the transparent ink is applied to protect the color ink transferred onto the recording paper, and wherein a length of the non-color ink portion in a conveyance direction is longer than a length acquired by adding a length necessary for transferring the transparent ink to a length from a position at which the transparent ink is transferred, to a position at which the transparent ink is not exposed from the ink cassette at a side of the supply bobbin.

12. The ink cassette according to claim 9, wherein the non-color ink portion at a leading end side in the conveyance direction of the ink ribbon is larger than the non-color ink portion at a rear end side in the conveyance direction thereof.

13. A method that performed by a thermal printer for transferring color ink onto recording paper includes an ink ribbon on which a color ink portion with the color ink applied thereon and a non-color ink portion with no color ink applied thereon are alternately formed in a conveyance direction, a supply bobbin on which the ink ribbon whose color ink is to be transferred by the thermal printer is wound, a take-up bobbin on which the ink ribbon drawn from the supply bobbin is wound, a housing that supports the supply bobbin and the take-up bobbin being apart from each other so that the ink ribbon is exposed between the supply bobbin and the take-up bobbin, and a mounting unit which mounts a detachable ink cassette on the thermal printer, the method comprising:

stopping, when an error occurs during transferring of the color ink, transferring the color ink; and conveying, when the error occurs during transferring of the color ink, the ink ribbon so that the exposed portion of the ink ribbon is the non-color ink portion.

* * * * *